US008322995B2

(12) United States Patent
Ehimeakhe et al.

(10) Patent No.: US 8,322,995 B2
(45) Date of Patent: Dec. 4, 2012

(54) CALCULATION OF DOWNHOLE PUMP FILLAGE AND CONTROL OF PUMP BASED ON SAID FILLAGE

(75) Inventors: Victoria M. Ehimeakhe, Katy, TX (US); Ken George Booth, Lopez Island, WA (US)

(73) Assignee: Weatherford/Lamb, Inc., Houston, TX (US)

( * ) Notice: Subject to any disclaimer, the term of this patent is extended or adjusted under 35 U.S.C. 154(b) by 435 days.

(21) Appl. No.: 12/719,673

(22) Filed: Mar. 8, 2010

(65) Prior Publication Data

US 2011/0091335 A1 Apr. 21, 2011

Related U.S. Application Data

(60) Provisional application No. 61/252,000, filed on Oct. 15, 2009.

(51) Int. Cl.

| | |
|---|---|
| ***F04B 43/12*** | (2006.01) |
| ***F04B 53/12*** | (2006.01) |
| ***G01F 3/14*** | (2006.01) |
| ***G05D 7/00*** | (2006.01) |

(52) U.S. Cl. ..... 417/53; 417/63; 417/555.2; 73/248; 700/282; 702/156

(58) Field of Classification Search ..... 417/53, 417/63, 555.2; 73/239, 248; 700/46, 282; 702/6, 156

See application file for complete search history.

(56) References Cited

U.S. PATENT DOCUMENTS

| | | | | |
|---|---|---|---|---|
| 3,998,568 | A * | 12/1976 | Hynd | 417/12 |
| 4,034,808 | A | 7/1977 | Patterson | |
| 4,286,925 | A | 9/1981 | Standish | |
| 4,490,094 | A * | 12/1984 | Gibbs | 417/42 |
| 4,973,226 | A | 11/1990 | McKee | |
| 5,252,031 | A | 10/1993 | Gibbs | |
| 5,257,912 | A * | 11/1993 | Oakley et al. | 417/63 |
| 7,212,923 | B2 * | 5/2007 | Gibbs et al. | 702/13 |
| 7,500,390 | B2 * | 3/2009 | Mills | 73/152.61 |
| 7,891,237 | B2 * | 2/2011 | Mills | 73/152.61 |

OTHER PUBLICATIONS

GB Search Report for Application No. GB1017445.6, dated Jan. 14, 2011.

* cited by examiner

*Primary Examiner* — Charles Freay
(74) *Attorney, Agent, or Firm* — Patterson & Sheridan, LLP

(57) ABSTRACT

Methods and apparatus are provided for determining pump fillage, using data arrays of pump plunger position with respect to time and/or pump plunger load with respect to time. In this manner, well operators may be able to accurately monitor the pump fillage and control the pump accordingly.

20 Claims, 8 Drawing Sheets

CALCULATION OF DOWNHOLE PUMP FILLAGE AND CONTROL OF PUMP BASED ON SAID FILLAGE

CROSS-REFERENCE TO RELATED APPLICATIONS

This application claims benefit of U.S. Provisional Patent Application Ser. No. 61/252,000, filed Oct. 15, 2009, which is herein incorporated by reference.

BACKGROUND OF THE INVENTION

1. Field of the Invention

Embodiments of the present invention generally relate to estimating efficiency and controlling the operation of a downhole pump disposed in a wellbore. More particularly, embodiments of the present invention generally relate to accurately determining a transfer point of a pump stroke and controlling the pump and fluid production of the well based on the transfer point.

2. Description of the Related Art

The production of oil with a sucker-rod pump is common practice in the oil and gas industry. Typically, the pumping system is designed with the capacity to remove liquid from the wellbore faster than the reservoir may be able to supply liquid into the wellbore. In a fluid-producing well that is aided by artificial lift in the form of a rod pumping system, a condition may arise where the pump is not completely filled with fluid on each pump stroke. The well is said to be "pumped off," and the condition is known as "pounding."

It is desired to know the quantity of fluid entering the pump on each stroke (the pump "fillage") for a number of purposes including, e.g., to stop the pumping system periodically to allow more fluid to enter the wellbore or to control the speed of the pumping system so that it does not pump more fluid than enters the wellbore. Knowing the pump fillage also allows the total amount of fluid produced by the well to be calculated.

Other methods have previously relied on the shape of the graphical representation of the downhole card to compute the pump fillage. For example, U.S. Pat. No. 5,252,031 to Gibbs, entitled "Monitoring and Pump-Off Control with Downhole Pump Cards," teaches a method for monitoring a rod pumped well to detect various pump problems by utilizing measurements made at the surface to generate a downhole pump card. The graphically represented downhole pump card may then be used to detect the various pump problems and control the pumping unit. Owing to the diversity of card shapes, however, it can be difficult to make a diagnosis of downhole conditions solely on the basis of the shape of the graphical representation. Furthermore, in some instances, such graphical techniques may lead to inaccurate determinations of the pump fillage such that fluid production calculated therefrom may be incorrect.

Accordingly, techniques and systems that rely less on human interpretation in determining the pump fillage would be desirable.

SUMMARY OF THE INVENTION

Embodiments of the present invention generally provide methods and apparatus for determining the pump fillage using data arrays of pump position with respect to time and pump load with respect to time.

One embodiment of the present invention is a method. The method generally includes determining a transfer point of a stroke of a pump—the pump typically having a pump barrel, a plunger, a standing valve, and a traveling valve—wherein the transfer point occurs during a downstroke of the plunger such that a load is transferred from the traveling valve to the standing valve; and calculating a pump fillage based on the transfer point, wherein the pump fillage is a volume of the pump barrel between a bottom of stroke of the plunger and the transfer point. For some embodiments, the method further comprises controlling the pump based on the pump fillage.

Another embodiment of the present invention provides a system. The system generally includes a pump and a control unit for controlling the pump. The pump typically has a pump barrel, a plunger, a standing valve and a traveling valve. The control unit is typically configured to determine a transfer point of a stroke of the pump, wherein the transfer point occurs during a downstroke of the plunger such that a load is transferred from the traveling valve to the standing valve; and calculate a pump fillage based on the transfer point, wherein the pump fillage is a volume of the pump barrel between a bottom of stroke of the plunger and the transfer point. For some embodiments, the control unit may be further configured to control the pump based on the pump fillage.

Yet another embodiment of the present invention provides a computer-readable medium containing a program which, when executed by a processor, performs operations. The operations generally include determining a transfer point of a stroke of a pump—the pump typically having a pump barrel, a plunger, a standing valve, and a traveling valve—wherein the transfer point occurs during a downstroke of the plunger such that a load is transferred from the traveling valve to the standing valve; and calculating a pump fillage based on the transfer point, wherein the pump fillage is a volume of the pump barrel between a bottom of stroke of the plunger and the transfer point. For some embodiments, the operations may further comprise controlling the pump based on the pump fillage.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide numerical methods for determining pump fillage using data arrays of pump plunger position with respect to time and/or pump plunger load with respect to time. This may allow well operators to accurately monitor the pump fillage and control the pump accordingly.

Figure 1:
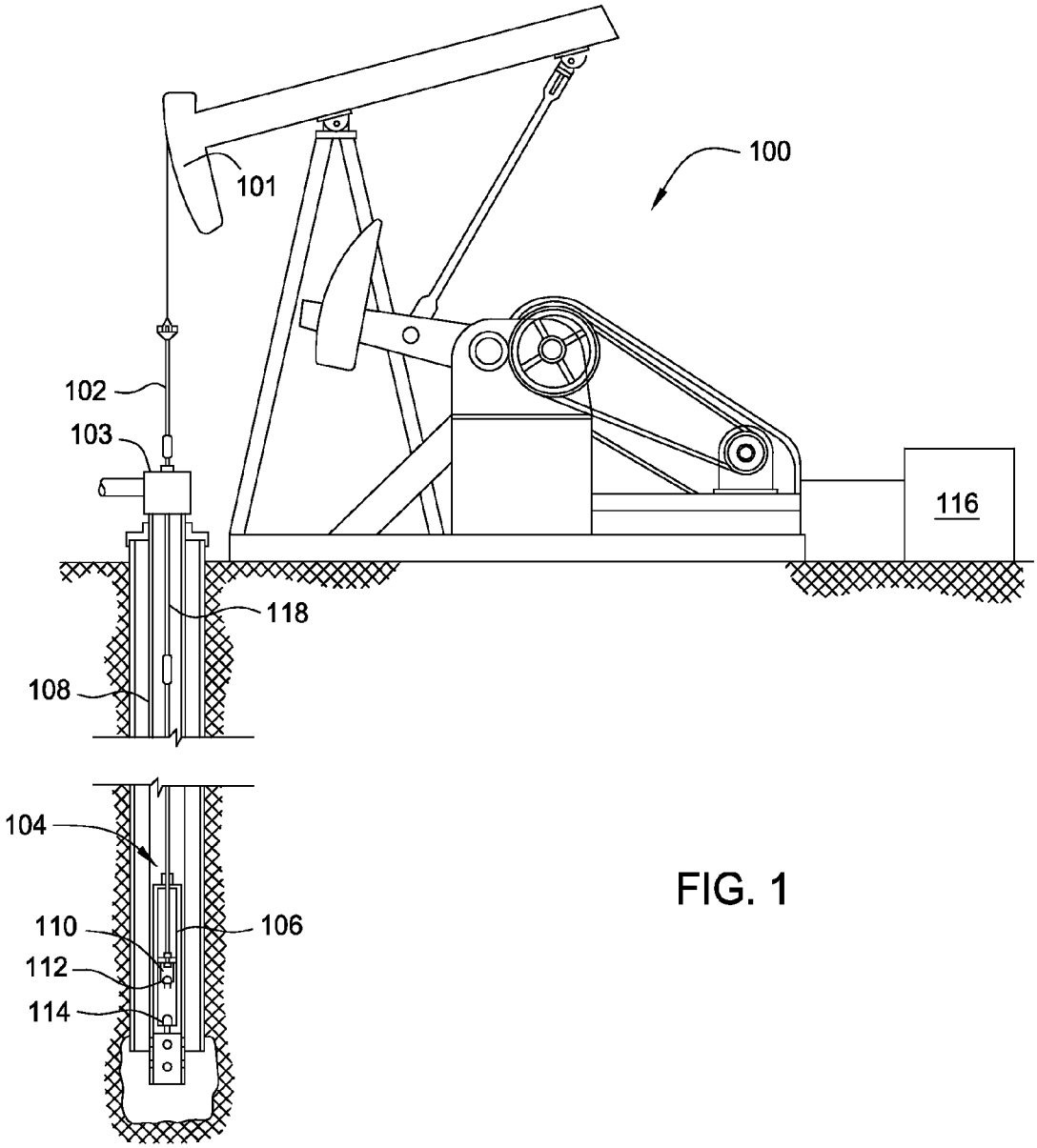
FIG. 1 is a schematic depiction of an illustrative sucker-rod pumping unit with a control unit for controlling the pump in an effort to extract fluid from a well.

The production of oil with a sucker-rod pump system 100 such as that depicted in FIG. 1 is common practice in the oil and gas industry. In the pump system 100, a rod pump 104 consists of a tubular barrel 106 with a valve 114 (the "standing valve") located at the bottom that allows fluid to enter from the wellbore, but does not allow the fluid to leave. Inside the pump barrel 106 is a close-fitting hollow plunger 110 with another valve 112 (the "traveling valve") located at the top. This allows fluid to move from below the plunger 110 to the production tubing 108 above and does not allow fluid to return from the tubing 108 to the pump barrel 106 below the plunger 110. The plunger 110 may be moved up and down cyclically by a horsehead 101 at the surface via the rod string 102, wherein the motion of the pump plunger 110 comprises an "upstroke" and a "downstroke," jointly referred to as a "stroke."

During the part of the pump cycle where the plunger 110 is moving upward (the upstroke), the traveling valve 112 is closed, and any fluid above the plunger 110 in the production tubing 108 may be lifted towards the surface. Meanwhile, the standing valve 114 opens and allows fluid to enter the pump barrel 106 from the wellbore.

The highest point of the pump plunger motion may be referred to as the "top of stroke" or TOS, while the lowest point of the pump plunger motion may be referred to as the "bottom of stroke" or BOS. At the TOS, the weight of the fluid in the production tubing 108 may be supported by the traveling valve 112 in the plunger 110 and, therefore, also by the rod string 102. This load causes the rod string 102 to be stretched. At this point, the standing valve 114 closes and holds in the fluid that has entered the pump barrel 106.

During the part of the pump cycle where the plunger 110 is moving downward (the "downstroke"), the traveling valve 112 initially remains closed until the plunger 110 reaches the surface of the fluid in the barrel. Sufficient pressure may be built up in the fluid below the traveling valve 112 to balance the pressure due to the column of fluid to the surface in the production tubing 108. The build-up of pressure in the pump barrel 106 reduces the load on the rod string 102; this causes the stretching of the rod string 102 that occurred during the upstroke to relax. This process takes place during a finite amount of time when the plunger 110 rests on the fluid, and the horsehead 101 at the surface allows the top of the rod string 102 to move downward.

The position of the pump plunger 110 at this time is known as the "transfer point" as the load of the fluid column in the production tubing 108 is transferred from the traveling valve 112 to the standing valve 114. This results in a rapid decrease in load on the rod string 102 during the transfer. After the pressure below the traveling valve 112 balances the one above, the valve 112 opens and the plunger 110 continues to move downward to its lowest position (the BOS). The movement of the plunger 110 from the transfer point to the BOS is known as the "fluid stroke" and is a measure of the amount of fluid lifted by the pump 104 on each stroke. In other words, the portion of the pump stroke below the transfer point may be interpreted as the percentage of the pump stroke containing fluid. This percentage is the pump fillage.

Typically, there are no sensors to measure conditions at the pump 104, which may be located thousands of feet underground. However, there exist numerical methods to calculate the position of the pump plunger 110 and the load acting on the plunger from measurements of the position of and load in the rod string 102 at the pumping unit located at the surface. These measurements are typically made at the top of the polished rod 118, which is a portion of the rod string 102 passing through a stuffing box 103.

Figure 2A:
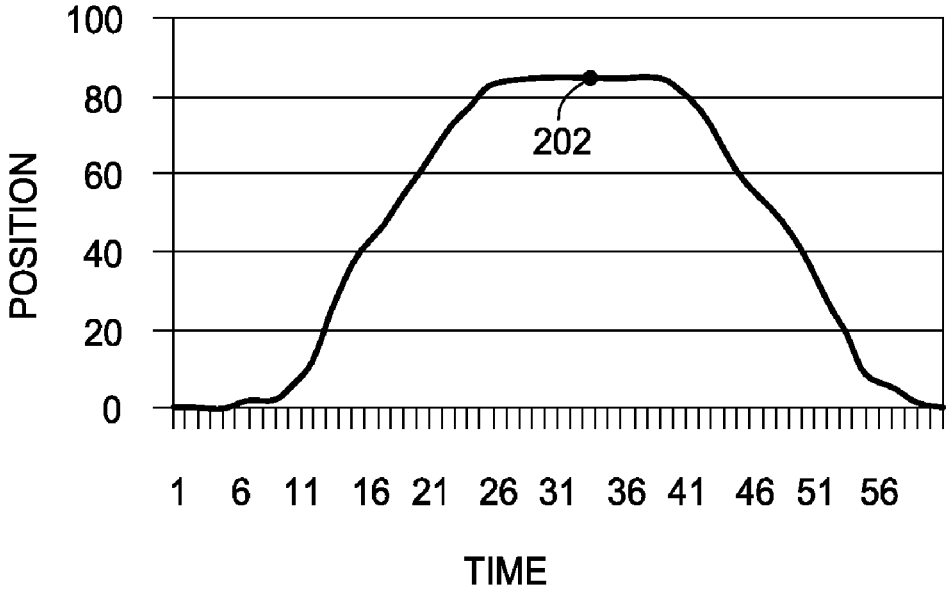
FIGS. 2A and 2B illustrate position versus time data for a completely filled or nearly filled well and a pumped off well, respectively.

If there is sufficient fluid in the wellbore, the pump barrel 106 may be completely filled during an upstroke. FIG. 2A illustrates position versus time data obtained downhole where the pump 104 may be completely or nearly filled. This represents ideal pump operation where the transfer point 202 may be at the TOS of the plunger 110 for a completely or nearly filled pump barrel 106.

Figure 2B:
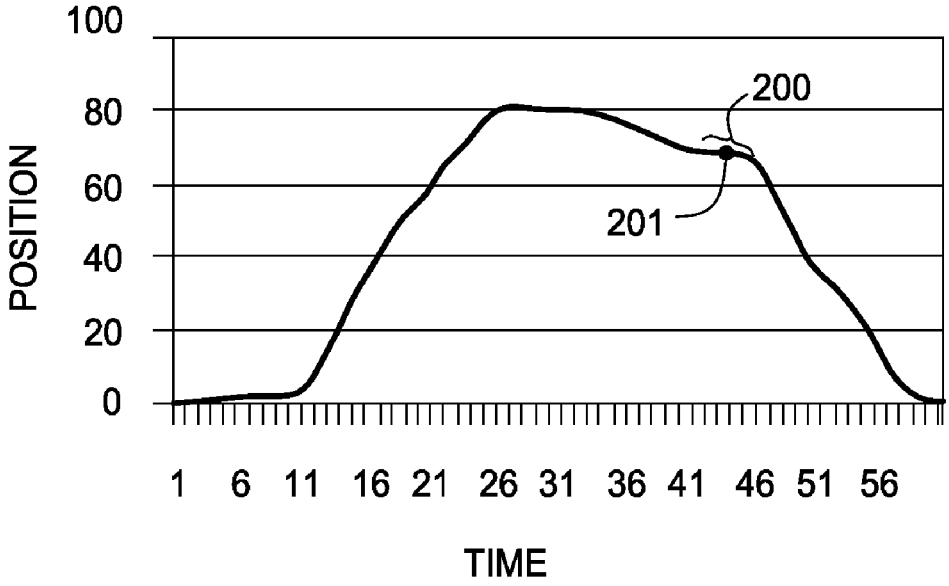

A condition may arise where the pump 104 is not completely filled with fluid on an upstroke. If there is not sufficient fluid in the wellbore, the barrel 106 may be only partially filled, and there may be a void left between the fluid and the plunger 110 as it continues to rise. Operating the pump system 100 with only a partially filled pump barrel is inefficient and, therefore, undesirable. The well is said to be "pumped off," and the condition is known as "pounding." For a pumped off well, in contrast with the completely filled pump of FIG. 2A, a plot of the position versus time data may contain a plateau 200, as shown in FIG. 2B. The plateau 200 may most likely contain the transfer point 201. For a pumped off well, the transfer point may most likely occur after the TOS of the plunger 110. Thus, well operators may wish to accurately determine the transfer point in an effort to monitor the pump fillage and to control the pump accordingly, thereby preventing damage to the rod string 102 and other components of the pump system 100.

Figure 3:
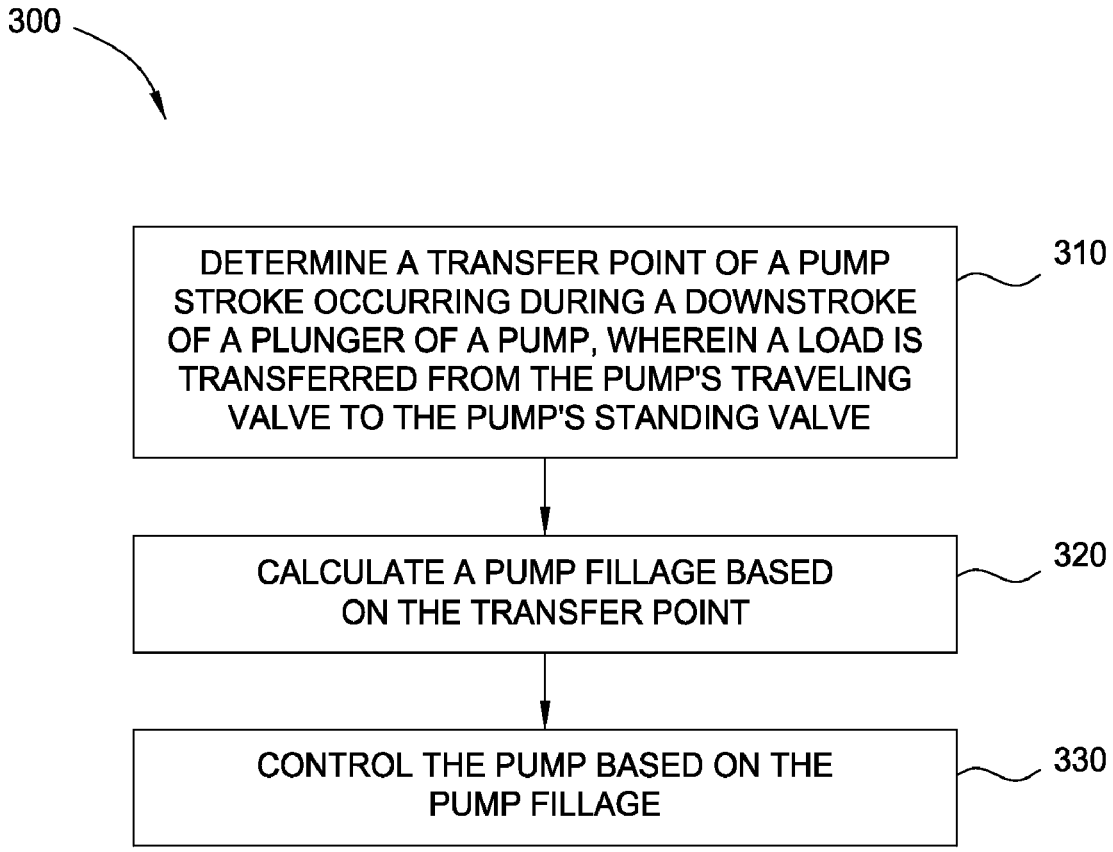
FIG. 3 is a flow diagram of exemplary operations for controlling a pump based on a transfer point of a pump stroke.

FIG. 3 illustrates operations 300 for controlling a pump system 100 based on a transfer point of a stroke, according to embodiments of the present invention. The operations may begin at 310 by determining the transfer point, wherein a load is transferred from the pump's traveling valve 112 to the pump's standing valve 114. For some embodiments, the transfer point may be continuously determined for each and every pump stroke. For other embodiments, the transfer point may be determined periodically or, in some cases, less frequently when the transfer point is at or near the TOS, and more frequently, when the transfer point is determined to be substantially less than the TOS.

At 320, the pump fillage (a fluid volume) may then be calculated based on the transfer point. In other words, this fluid volume may be calculated by determining the volume of the pump barrel 106 between the transfer point and the BOS. If the transfer point is accurately determined, the calculated pump fillage may most likely be correct. A control unit 116, which may be located at the surface, may control the pump system 100 and, thus, the motion of the pump 104 based on the pump fillage at 330. For example, the control unit 116 may control the pump cycle frequency, the pump interval and the delay between pump intervals (i.e., the variable pump duty cycle). The pump fillage may also be used to compute pump efficiency, the produced volume and/or the average production rate.

Determining the Transfer Point Using a Method of Ratios

Figure 4:
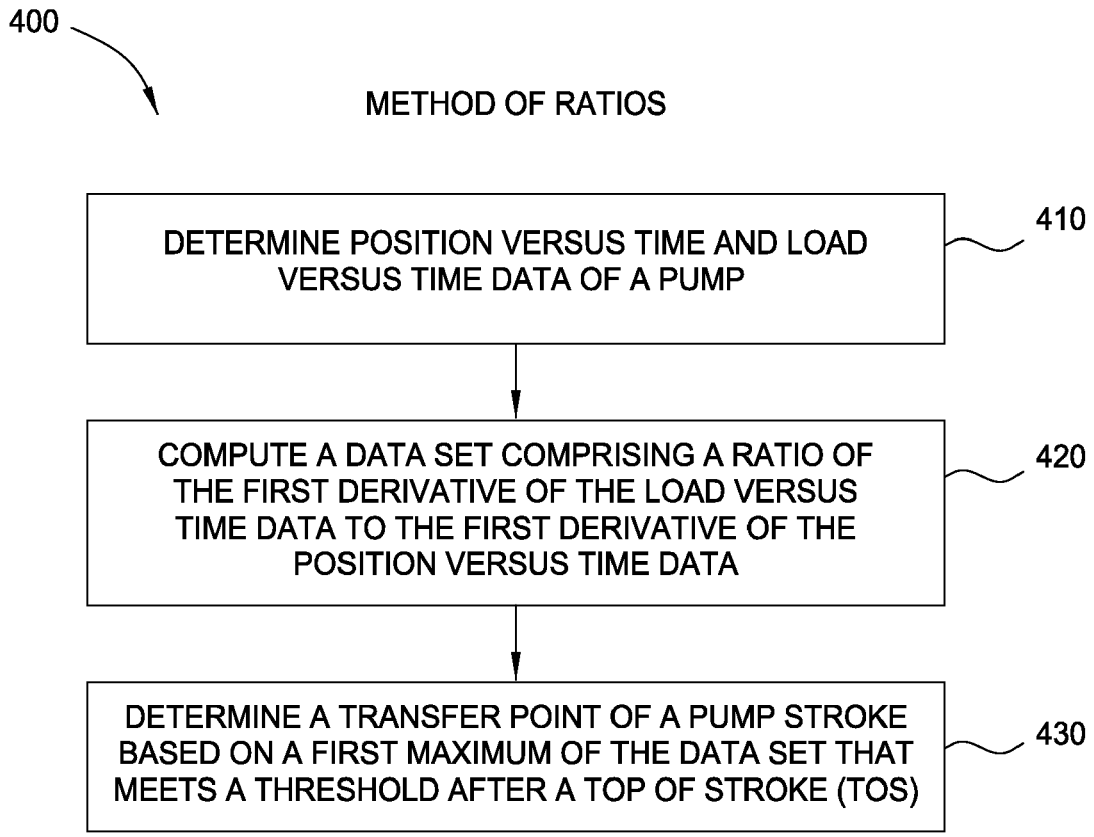
FIG. 4 is a flow diagram of exemplary operations for determining a transfer point of a pump stroke using a ratio-of-load-and-position-derivatives method (also considered and labeled as a Method of Ratios) according to an embodiment of the invention.

Various numerical methods for accurately determining the transfer point may exist. For example, FIG. 4 illustrates operations 400 for determining the transfer point at 310 using a ratio-of-load-and-position-derivatives (also considered and labeled as a Method of Ratios), according to embodiments of the present invention. Data sets comprising position and load of the pump 104 with respect to time may be determined from measurements made at the surface and/or downhole at 410 by any of various suitable sensors. For some embodiments, the data sets may correspond to measurements made at the pump 104. For some embodiments, the measurements may be transmitted to the control unit 116 for data collection and analysis.

Figure 5A:
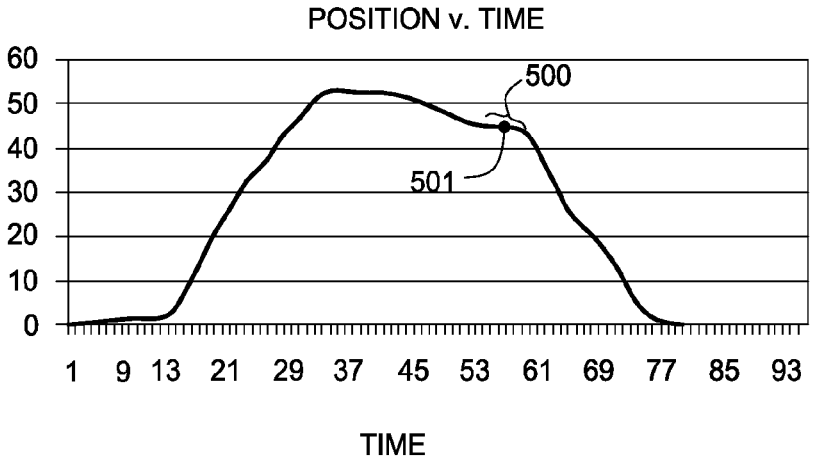
FIGS. 5A-C graphically illustrate data sets used in determining a transfer point of a pump stroke according to the operations of FIG. 4.
Figure 5B:
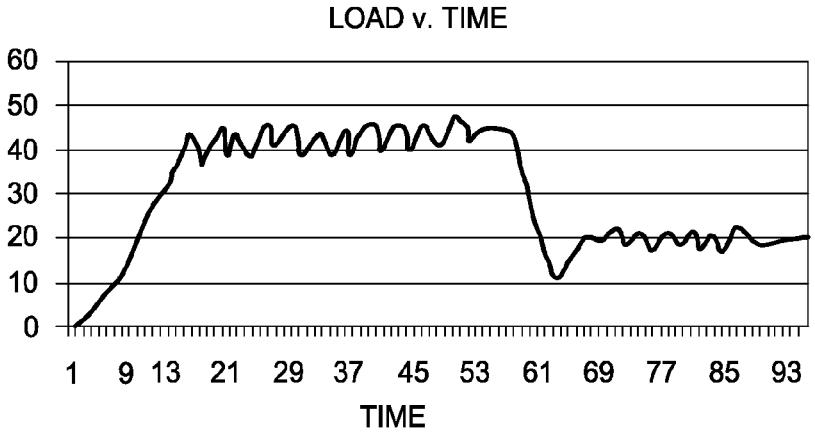

FIG. 5A displays a plot of example position versus time data, while FIG. 5B depicts a plot of example load versus time data. In FIG. 5A, a plateau 500 may indicate that the pump 104 is not completely filled during the part of the pump cycle where the plunger 110 is moving downward. The plateau 500 may most likely contain the transfer point 501. When the pump 104 is not completely filled, the transfer point may most likely occur after the TOS of the plunger 110.

Figure 5C:
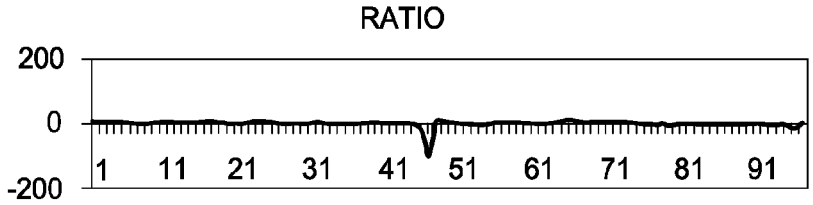

At 420, a data set may be computed, comprising a ratio of the first derivative of the load versus time data to the first derivative of the position versus time data, as displayed in FIG. 5C. The ratio may display a series of peaks after the TOS. For some embodiments, the position and load data may be normalized before calculating the derivatives. At the transfer point, the first derivative of position with respect to time (i.e., velocity) exhibits a local maximum, and the first derivative of load with respect to time exhibits an absolute minimum. Individually, these phenomena are not always unique; however, the ratio of the first derivatives typically exhibits a distinct maximum at the transfer point. Therefore, the transfer point may be determined at 430 based on a maximum (e.g., the first maximum) of the ratio data set that exceeds a threshold after the TOS.

Determining the Transfer Point Using a Method of Position

Figure 6:
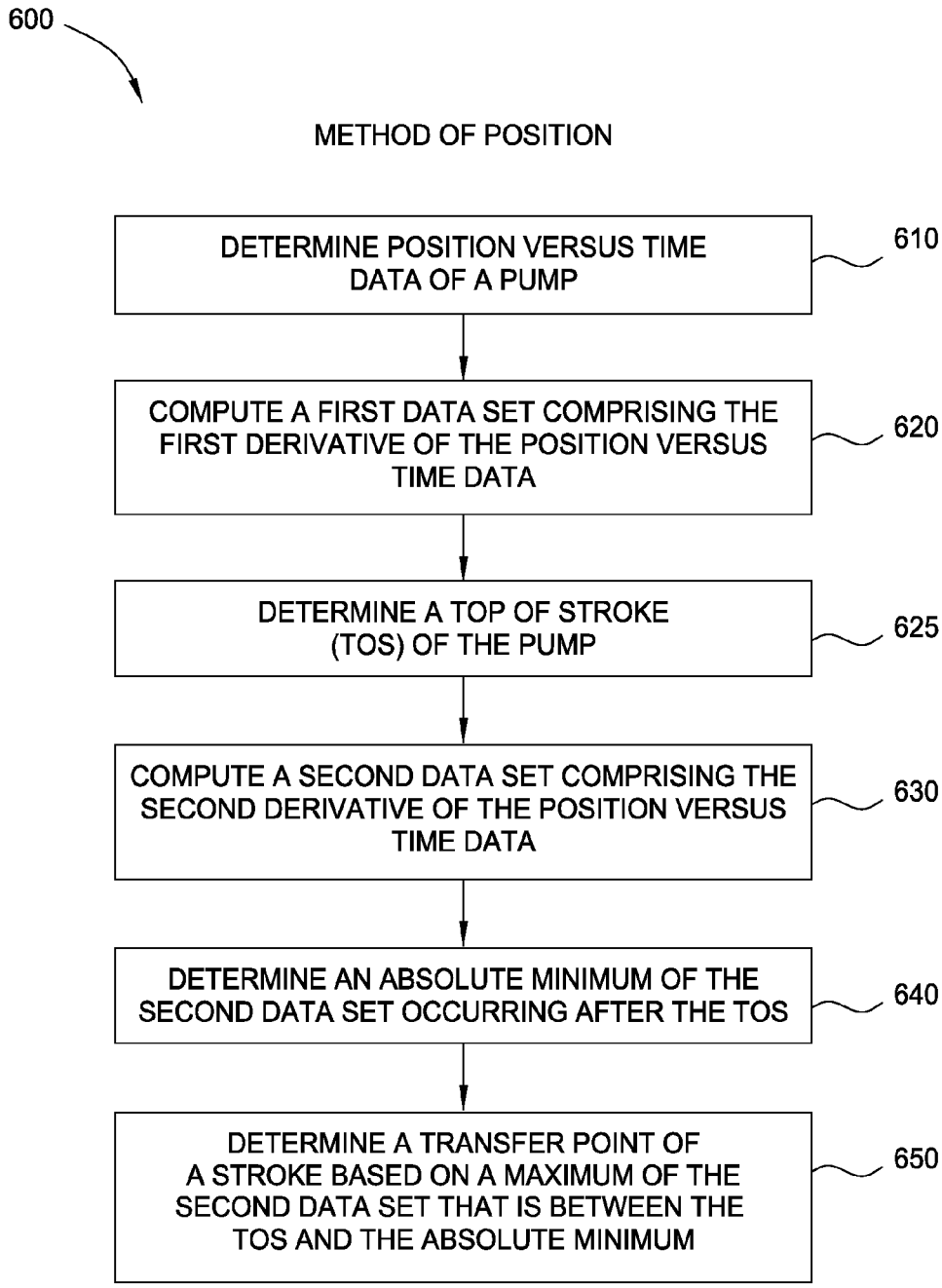
FIG. 6 is a flow diagram of exemplary operations for determining a transfer point of a pump stroke using a derivatives-of-position method (also considered and labeled as a Method of Position) according to an embodiment of the invention.
Figure 7A:
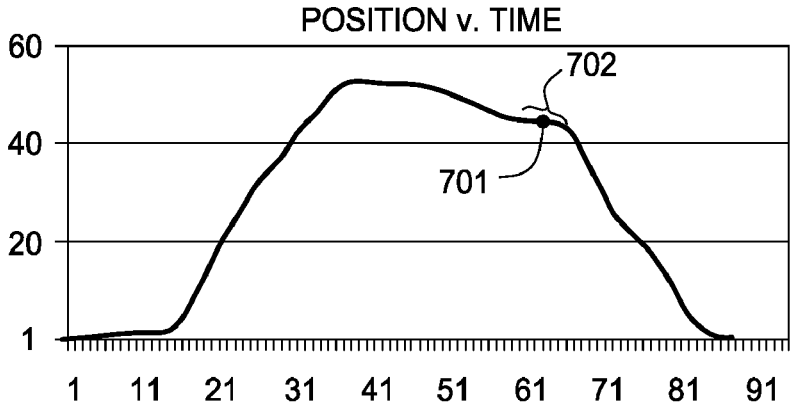
FIGS. 7A-C graphically illustrate data sets used in determining a transfer point of a stroke according to the operations of FIG. 6.

FIG. 6 illustrates operations 600 for determining the transfer point at 310 using a derivatives-of-position method (also considered and labeled as a Method of Position), according to embodiments of the present invention. Position of the pump 104 with respect to time may be determined from measurements made at the surface and/or downhole at 610 by any of various suitable sensors. For some embodiments, the position versus time data may correspond to measurements made at the pump 104. A plot of example position versus time data is displayed in FIG. 7A. In FIG. 7A, a plateau 702 may indicate that the pump 104 is not completely filled during the part of the pump cycle where the plunger 110 is moving downward. The plateau 702 may most likely contain the transfer point 701 at the inflection point. When the pump 104 is not completely filled, the transfer point may occur after the TOS of the plunger 110.

Figure 7B:
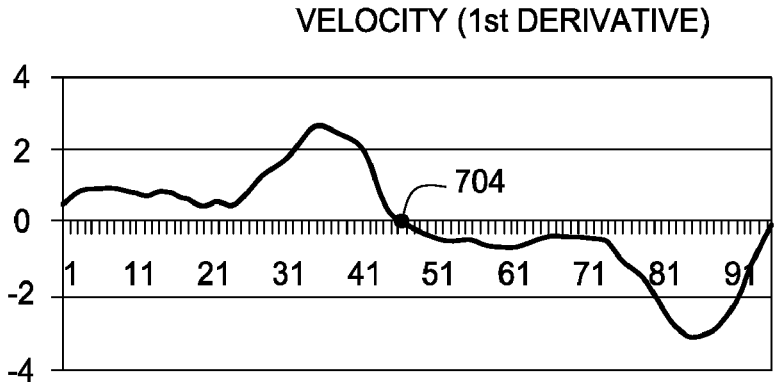

At 620, a first data set may be computed comprising the first derivative of the position versus time data (i.e., velocity). At 625, the TOS of the pump, and more specifically of the plunger, may be determined. For some embodiments, determining the TOS of the plunger may comprise finding a critical value 704 of the first data set, as displayed in FIG. 7B. For other embodiments, the TOS may be simply determined to occur at the maximum position in the position versus time data.

Figure 7C:
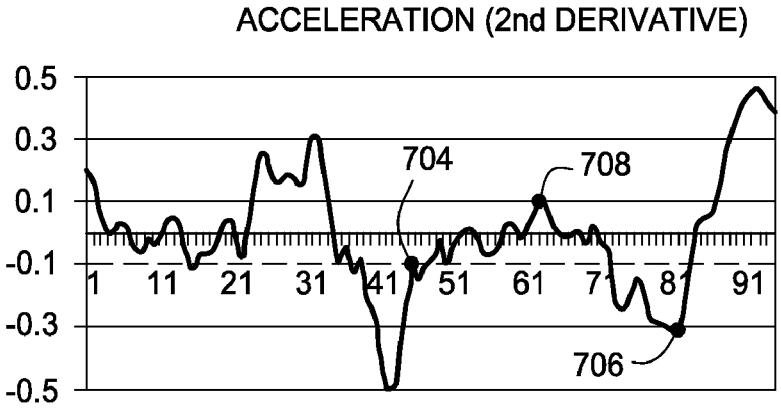

A second data set may be computed at 630 comprising the second derivative of the position versus time data (i.e., acceleration), and at 640, an absolute minimum 706 of the second data set occurring after the position corresponding to the TOS may be determined, as displayed in FIG. 7C. At 650, the transfer point may be determined based on a maximum 708 of the second data set that occurs between the TOS and the absolute minimum 706.

Data below a minimum pump fillage threshold (e.g., about 10-15%, or more preferably about 5%) may not be used in determining the transfer point because the calculation of the pump fillage at 320 may not be accurate. If the maximum 708 is not above the minimum pump fillage threshold, then this position may not be considered as the transfer point because an accurate pump fillage cannot be guaranteed.

Determining the Transfer Point Using a Method of Areas

Figure 8:
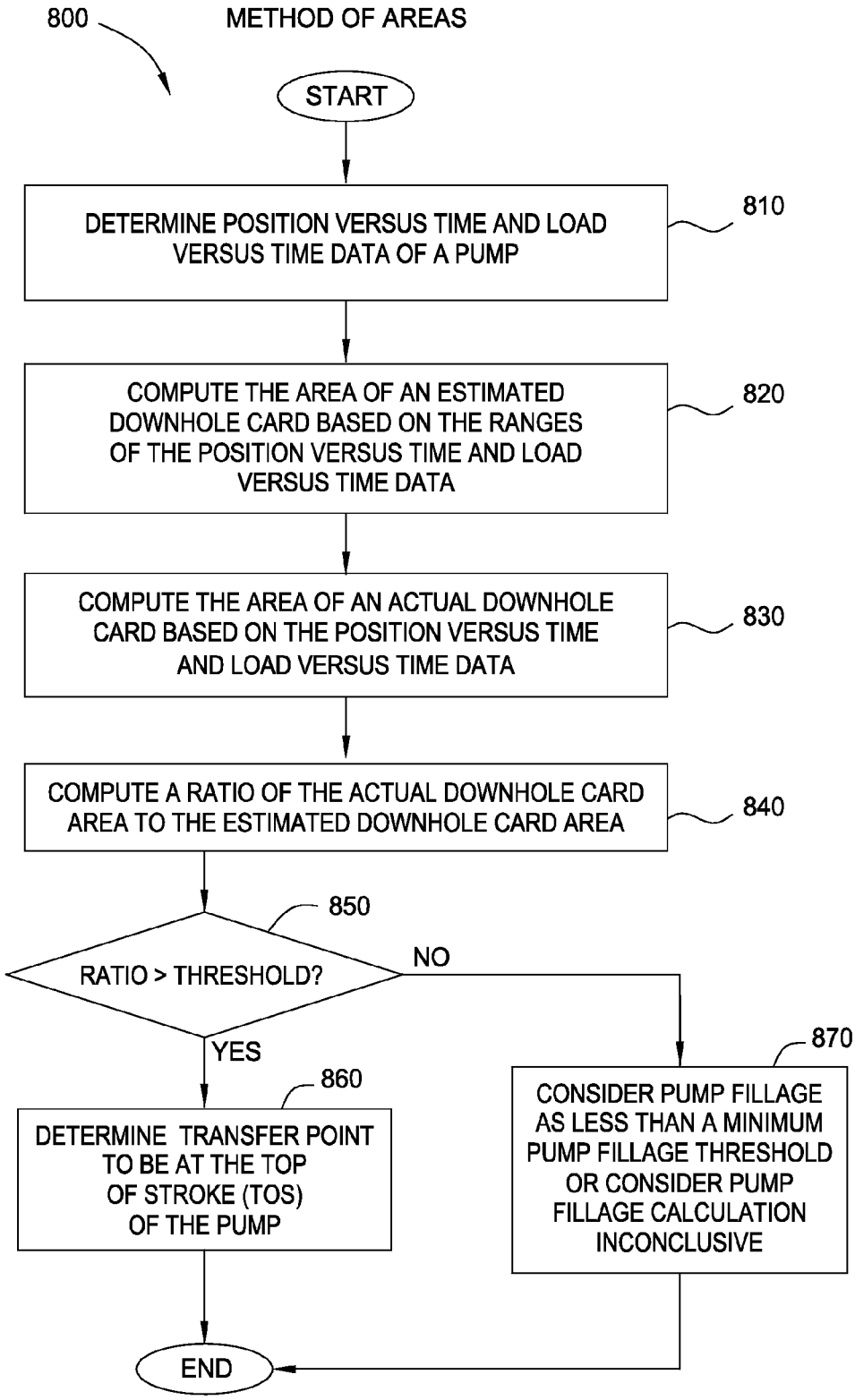
FIG. 8 is a flow diagram of exemplary operations for determining a transfer point of a stroke using a ratio-of-areas method (also considered and labeled as a Method of Areas) according to an embodiment of the invention.

FIG. 8 illustrates operations 800 for determining the transfer point at 310 using a ratio-of-areas method (also considered and labeled as a Method of Areas), according to embodiments of the present invention. The ratio-of-areas method may be used, for example, when there is sufficient fluid in the wellbore to cause the pump barrel 106 to be completely filled or nearly filled, as illustrated in FIG. 2A, such that the ratio-of-load-and-position-derivatives of FIG. 4 or the derivatives-of-position method of FIG. 6 fail to determine the transfer point, which may be at or near the TOS of the plunger 110. In addition, the ratio-of-areas method may be used when the well is pumped off enough that the pump fillage is less than the minimum pump fillage threshold (e.g., about 10-15%, or more preferably about 5%).

In the ratio-of-areas method, the position versus time and load versus time data may be determined at 810 from measurements made at the surface and/or downhole using any of various suitable sensors. For some embodiments, the data may correspond to measurements made at the pump 104. At 820, the area of an estimated ideal rectangular downhole card may be computed, based on the ranges of the position versus time and load versus time data. In other words, the maximum and the minimum load and the maximum and the minimum position may be determined. Then, the difference between the maximum and minimum positions may be multiplied by the difference between the maximum and minimum loads to compute the estimated downhole card area.

At 830, the area of an actual downhole card corresponding to the position versus time and load versus time data may be computed. For some embodiments, this actual downhole card area may be computed using Riemann sums. At 840, a ratio may be computed of the actual downhole card area, which represents the energy expended at the pump, to the estimated downhole card area.

At 850, if the ratio is greater than a threshold (e.g., around 80%, or more preferably at least 60%), then the transfer point may be determined as being at the TOS of the plunger at 860. If the ratio is less than or equal to the threshold at 850, then, at 870, the pump fillage may be determined as being less than the minimum pump fillage threshold, or the pump fillage calculation may be considered as inconclusive (i.e., bad data). Any time the pump fillage calculation (PFC) is considered inconclusive, the transfer point may be determined on the next or any subsequent pump stroke.

Using any of the numerical techniques described herein may provide a more accurate determination of pump fillage than other methods, such as those based on graphical representations of a downhole card, wherein it can be difficult to make a diagnosis of downhole conditions due to the diversity of card shapes. More accurate pump fillage calculations may provide better pump control, increased pump efficiency and more accurate well-production calculations.

Any of the operations described above, such as the operations 300, may be included as instructions in a computer-readable medium for execution by the control unit 116 or any other processor. The computer-readable medium may comprise any memory, such as read-only memory (ROM), random access memory (RAM), flash memory, an electrically erasable programmable ROM (EEPROM), a compact disc ROM (CD-ROM), or a floppy disk.

While the foregoing is directed to embodiments of the present invention, other and further embodiments of the invention may be devised without departing from the basic scope thereof, and the scope thereof is determined by the claims that follow.

The invention claimed is:

1. A method comprising:

determining a transfer point of a stroke of a pump, the pump comprising:

a pump barrel;

a plunger;

a standing valve; and a traveling valve, wherein the transfer point occurs during a downstroke of the plunger such that a load is transferred from the traveling valve to the standing valve; and calculating a pump fillage based on the transfer point, wherein the pump fillage is a volume of the pump barrel between a bottom of stroke of the plunger and the transfer point and wherein determining the transfer point comprises:

determining position versus time data and load versus time data of the pump;

computing a data set comprising a ratio of the first derivative of the load versus time data to the first derivative of the position versus time data; and determining the transfer point based on a first maximum of the data set that occurs after a top of stroke (TOS) of the plunger.

2. The method of claim 1, wherein determining the transfer point based on the first maximum comprises determining the transfer point based on the first maximum of the data set that exceeds a threshold.

3. The method of claim 1, further comprising normalizing the position versus time data and the load versus time data such that the first derivative of the load versus time data is the first derivative of the normalized load versus time data and the first derivative of the position versus time data is the first derivative of the normalized position versus time data.

4. A method comprising:

determining a transfer point of a stroke of a pump, the pump comprising:

a pump barrel;

a plunger;

a standing valve; and a traveling valve, wherein the transfer point occurs during a downstroke of the plunger such that a load is transferred from the traveling valve to the standing valve; and calculating a pump fillage based on the transfer point, wherein the pump fillage is a volume of the pump barrel between a bottom of stroke of the plunger and the transfer point and wherein determining the transfer point comprises:

determining position versus time data of the pump;

computing a first data set comprising the first derivative of the position versus time data;

determining a top of stroke (TOS) of the plunger;

computing a second data set comprising the second derivative of the position versus time data;

determining an absolute minimum of the second data set that occurs after the TOS; and determining the transfer point based on a maximum of the second data set that occurs between the TOS and the absolute minimum.

5. The method of claim 4, wherein determining the TOS of the plunger comprises finding a critical value of the first data set.

6. The method of claim 4, wherein determining the transfer point based on the maximum of the second data set comprises determining the transfer point based on the maximum of the second data set whose corresponding position exceeds a minimum pump fillage threshold.

7. The method of claim of claim 6, wherein the minimum pump fillage threshold is about 5% of the TOS of the plunger.

8. A method comprising:

determining a transfer point of a stroke of a pump, the pump comprising:

a pump barrel;

a plunger;

a standing valve; and a traveling valve, wherein the transfer point occurs during a downstroke of the plunger such that a load is transferred from the traveling valve to the standing valve; and calculating a pump fillage based on the transfer point, wherein the pump fillage is a volume of the pump barrel between a bottom of stroke of the plunger and the transfer point and wherein determining the transfer point comprises:

determining position versus time data and load versus time data of the pump;

computing the area of an estimated downhole card based on the ranges of the position versus time data and the load versus time data;

computing the area of an actual downhole card based on the position versus time data and the load versus time data;

computing a ratio of the actual downhole card area to the estimated downhole card area; and if the ratio exceeds a threshold, determining the transfer point to be at a top of stroke (TOS) of the plunger.

9. The method of claim 8, wherein computing the area of the actual downhole card comprises using Riemann sums.

10. The method of claim 8, wherein the threshold is about 60%.

11. The method of claim 8, wherein computing the area of the estimated downhole card comprises:

determining a maximum position and a minimum position from the position versus time data;

determining a maximum load and a minimum load from the load versus time data; and multiplying a difference between the maximum and minimum positions by a difference between the maximum and minimum loads.

12. The method of claim 8, further comprising controlling the pump based on the pump fillage.

13. A system comprising:
a pump comprising:
a pump barrel;
a plunger;
a standing valve; and
a traveling valve; and
a control unit for controlling the pump, wherein the control unit is configured to:
determine a transfer point of a stroke of the pump by:
determining position versus time data and load versus time data of the pump;
computing a data set comprising a ratio of the first derivative of the load versus time data to the first derivative of the position versus time data; and
determining the transfer point based on a first maximum of the data set that occurs after a top of stroke (TOS) of the plunger and exceeds a threshold; and calculate a pump fillage based on the transfer point, wherein the pump fillage is a volume of the pump barrel between a bottom of stroke of the plunger and the transfer point.

14. A system comprising:
a pump comprising:
a pump barrel;
a plunger;
a standing valve; and
a traveling valve; and
a control unit for controlling the pump, wherein the control unit is configured to:
determine a transfer point of a stroke of the pump by:
determining position versus time data of the pump;
computing a first data set comprising the first derivative of the position versus time data;
determining a top of stroke (TOS) of the plunger;
computing a second data set comprising the second derivative of the position versus time data;
determining an absolute minimum of the second data set that occurs after the TOS; and
determining the transfer point based on a maximum of the second data set that occurs between the TOS and the absolute minimum; and
calculate a pump fillage based on the transfer point, wherein the pump fillage is a volume of the pump barrel between a bottom of stroke of the plunger and the transfer point.

15. The system of claim 14, wherein determining the transfer point based on the maximum of the second data set comprises determining the transfer point based on the maximum of the second data set whose corresponding position exceeds a minimum pump fillage threshold.

16. A system comprising:
a pump comprising:
a pump barrel;
a plunger;
a standing valve; and
a traveling valve; and
a control unit for controlling the pump, wherein the control unit is configured to:
determine a transfer point of a stroke of the pump by:
determining position versus time data and load versus time data of the pump; computing the area of an estimated downhole card based on the ranges of the position versus time data and the load versus time data;
computing the area of an actual downhole card based on the position versus time data and the load versus time data;
computing a ratio of the actual downhole card area to the estimated downhole card area; and
if the ratio exceeds a threshold, determining the transfer point to be at a top of stroke (TOS) of the plunger; and
calculate a pump fillage based on the transfer point, wherein the pump fillage is a volume of the pump barrel between a bottom of stroke of the plunger and the transfer point.

17. The system of claim 16, wherein computing the area of the estimated downhole card comprises:
determining a maximum position and a minimum position from the position versus time data;
determining a maximum load and a minimum load from the load versus time data; and
multiplying a difference between the maximum and minimum positions by a difference between the maximum and minimum loads.

18. A computer-readable medium containing a program which, when executed by a processor, performs operations comprising:
determining a transfer point of a stroke of a pump, the pump comprising:
a pump barrel;
a plunger;
a standing valve; and
a traveling valve, wherein the transfer point occurs during a downstroke of the plunger such that a load is transferred from the traveling valve to the standing valve; and
calculating a pump fillage based on the transfer point, wherein the pump fillage is a volume of the pump barrel between a bottom of stroke of the plunger and the transfer point and wherein determining the transfer point comprises:
determining position versus time data and load versus time data of the pump;
computing a data set comprising a ratio of the first derivative of the load versus time data to the first derivative of the position versus time data; and
determining the transfer point based on a first maximum of the data set that occurs after a top of stroke (TOS) of the plunger.

19. A computer-readable medium containing a program which, when executed by a processor, performs operations comprising:
determining a transfer point of a stroke of a pump, the pump comprising:
a pump barrel;
a plunger;
a standing valve; and
a traveling valve, wherein the transfer point occurs during a downstroke of the plunger such that a load is transferred from the traveling valve to the standing valve; and
calculating a pump fillage based on the transfer point, wherein the pump fillage is a volume of the pump barrel between a bottom of stroke of the plunger and the transfer point and wherein determining the transfer point comprises:
determining position versus time data of the pump;
computing a first data set comprising the first derivative of the position versus time data;
determining a top of stroke (TOS) of the plunger;

computing a second data set comprising the second derivative of the position versus time data;

determining an absolute minimum of the second data set that occurs after the TOS; and determining the transfer point based on a maximum of the second data set that occurs between the TOS and the absolute minimum.

20. A computer-readable medium containing a program which, when executed by a processor, performs operations comprising:

determining a transfer point of a stroke of a pump, the pump comprising:

a pump barrel;

a plunger;

a standing valve; and a traveling valve, wherein the transfer point occurs during a downstroke of the plunger such that a load is transferred from the traveling valve to the standing valve; and calculating a pump fillage based on the transfer point, wherein the pump fillage is a volume of the pump barrel between a bottom of stroke of the plunger and the transfer point and wherein determining the transfer point comprises:

determining position versus time data and load versus time data of the pump;

computing the area of an estimated downhole card based on the ranges of the position versus time data and the load versus time data;

computing the area of an actual downhole card based on the position versus time data and the load versus time data;

computing a ratio of the actual downhole card area to the estimated downhole card area; and if the ratio exceeds a threshold, determining the transfer point to be at a top of stroke (TOS) of the plunger.

* * * * *